US011621514B2

(12) United States Patent
Weaver et al.

(10) Patent No.: US 11,621,514 B2
(45) Date of Patent: Apr. 4, 2023

(54) ELECTRICAL CONNECTOR WITH CONNECTOR HOUSING JOINED BY A FLEXIBLE JOINING MEMBER

(71) Applicant: TE Connectivity Services GmbH, Schaffhausen (CH)

(72) Inventors: Brian Keith Weaver, Middletown, PA (US); David T. Humphrey, Middletown, PA (US); William James Moyer, II, Middletown, PA (US)

(73) Assignee: TE CONNECTIVITY SOLUTIONS GMBH, Schaffhausen (CH)

( * ) Notice: Subject to any disclaimer, the term of this patent is extended or adjusted under 35 U.S.C. 154(b) by 22 days.

(21) Appl. No.: 17/333,756

(22) Filed: May 28, 2021

(65) Prior Publication Data

US 2022/0384982 A1 Dec. 1, 2022

(51) Int. Cl.

| | |
|---|---|
| ***H01R 13/502*** | (2006.01) |
| ***H01R 13/05*** | (2006.01) |
| ***H01R 13/405*** | (2006.01) |
| ***H01R 13/629*** | (2006.01) |

(52) U.S. Cl.

CPC ..... *H01R 13/502* (2013.01); *H01R 13/05* (2013.01); *H01R 13/405* (2013.01); *H01R 13/629* (2013.01)

(58) Field of Classification Search

CPC .... H01R 13/502; H01R 13/05; H01R 13/405; H01R 13/629

See application file for complete search history.

(56) References Cited

U.S. PATENT DOCUMENTS

| | | | | |
|---|---|---|---|---|
| 5,567,115 | A * | 10/1996 | Carbone | F16M 11/38 362/198 |
| 11,114,803 | B2 * | 9/2021 | Laurx | H01R 13/6471 |
| 2014/0078664 | A1 | 3/2014 | Lau et al. | |
| 2017/0170588 | A1 | 6/2017 | Doi | |
| 2020/0112114 | A1 | 4/2020 | Chiarelli | |
| 2020/0381872 | A1 * | 12/2020 | Laurx | H01R 13/6587 |
| 2022/0255263 | A1 * | 8/2022 | Martin | H01R 13/631 |

OTHER PUBLICATIONS

Extended European Search Report for European Application No. 22175955, dated Oct. 24, 2022.

* cited by examiner

*Primary Examiner* — Peter G Leigh
*Assistant Examiner* — Nader J Alhawamdeh

(57) ABSTRACT

An electrical connector having a first housing and a second housing. The first housing have a first mating face and a first cable receiving face with at least one first terminal receiving cavity which extends from the first cable receiving face to the first mating face. The second housing has a second mating face and a second cable receiving face with at least one second terminal receiving cavity which extends from the second cable receiving face to the second mating face. The second housing is spaced from the first housing. A flexible joining member extends from the first housing to the second housing. The flexible joining member is configured to allow the first housing to move independently of the second housing as the electrical connector is mounted to an electrical component. The first housing can be mated independently to the electrical component from the second housing.

20 Claims, 4 Drawing Sheets

ELECTRICAL CONNECTOR WITH CONNECTOR HOUSING JOINED BY A FLEXIBLE JOINING MEMBER

FIELD OF THE INVENTION

The present invention is directed to an electrical connector with connector halves that can be mated independently to reduce the mating force. In particular, the invention is directed to an electrical connection which has a flexible joining member that extends between connector halves to allow the connector halves to be joined together while allowing independent movement of the connector halves.

BACKGROUND OF THE INVENTION

When mating an electrical connector to mating components the mating force required to mate the electrical terminals of the electrical connector to the mating terminals of the mating components can be significant. As the mating force increases, due to the number or configurations of the terminals, the possibility of improper mating increases. In addition, as the mating force increases, it is difficult from an ergonomic perspective for the user or operator to properly effect mating.

It would, therefore, be desirable to provide an electrical connector which reduces the mating force required to mate with a mating component. In particular, it would be beneficial to have an electrical connector with connector halves that can be mated independently to reduce the mating force.

SUMMARY OF THE INVENTION

An embodiment is directed to an electrical connector having a first housing and a second housing. The first housing have a first mating face and a first cable receiving face with at least one first terminal receiving cavity which extends from the first cable receiving face to the first mating face. The second housing has a second mating face and a second cable receiving face with at least one second terminal receiving cavity which extends from the second cable receiving face to the second mating face. The second housing is spaced from the first housing. A flexible joining member extends from the first housing to the second housing. The flexible joining member is configured to allow the first housing to move independently of the second housing as the electrical connector is mounted to an electrical component. The first housing can be mated independently to the electrical component from the second housing.

An embodiment is directed to an electrical connector for mating to a mating electrical component. The electrical connector includes a first housing having a first mating face and a second housing have a second mating face. The second housing is spaced from the first housing. In some embodiments, a flexible joining member is integrally molded with the first housing and the second housing. The flexible joining member extends from the first housing to the second housing and is configured to allow the first housing to move independently of the second housing. The first housing can be mated independently to the mating electrical component from the second housing.

An embodiment is directed to an electrical connector for mating to a mating electrical component. The electrical connector includes a first housing with a first mating face. The first housing has a first recess provided in a first side wall of the first housing. The electrical connector includes a second housing which has a second mating face. The second housing has a second recess provided in a second side wall of the second housing. The second housing being spaced from the first housing with the first recess facing the second recess. A flexible joining member is positioned in the first recess and the second recess. The flexible joining member extends from the first housing to the second housing and is configured to allow the first housing to move independently of the second housing. The first housing can be mated independently to the mating electrical component from the second housing.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
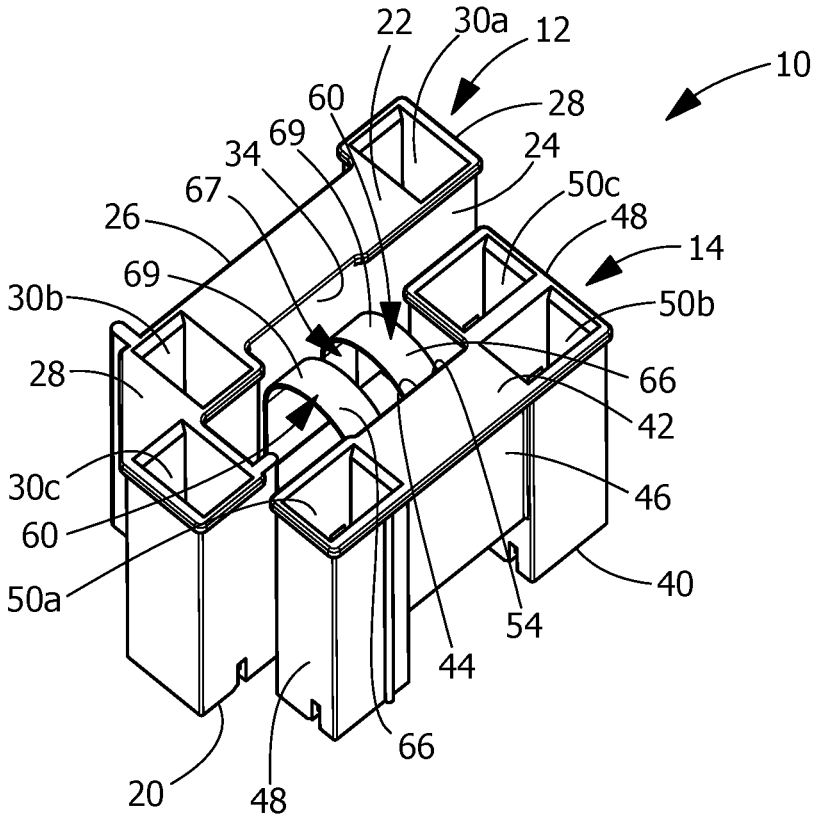
FIG. 1 is a top perspective view of an illustrative electrical connector according to the present invention, the electrical connector having a first housing and a second housing which is joined by a flexible joining member.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
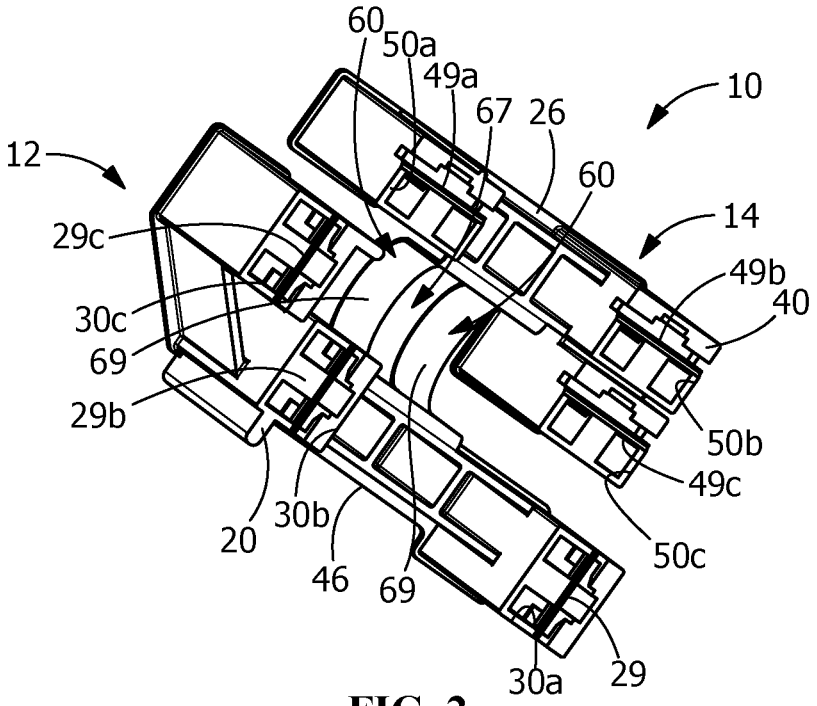
FIG. 2 is a bottom perspective view of the electrical connector of FIG. 1.

As shown in FIGS. 1 and 2, electrical connector 10 has a first housing 12 and a second housing 14. The first housing 12 is spaced from the second housing 14.

The first housing 12 has a mating face 20 and an oppositely facing wire or cable receiving face 22. A first side wall 24 and a second side wall 26 extend between the mating face 20 and the cable receiving face 22. End walls 28 extend between the mating face 20 and the cable receiving face 22 and between the first side wall 24 and the second side wall 26. One or more terminal receiving cavities 30*a*, 30*b*, 30*c* extend between the mating face 20 and the cable receiving face 22. The terminal receiving cavities 30*a*, 30*b*, 30*c* may have the same configuration or may differ in configurations. The terminal receiving cavities are configured to receive terminals 29*a*, 29*b*, 29*c* (FIG. 2) therein. The terminals may be of various configurations, including, but not limited to male terminals and female terminals. Other configurations of the first housing 12 may be used without departing from the scope of the invention.

In the illustrative embodiment shown, the housing 12 has a generally L-shaped configuration, with the first side wall 24 having a recess section or recess 34 provided therein. In the embodiment shown, various terminal receiving cavities 30*a*, 30*b*, 30*c* are offset from each other and from a longitudinal axis of the first housing 12. However, other configurations may be used.

The second housing 14 has a mating face 40 and an oppositely facing wire or cable receiving face 42. A first side wall 44 and a second side wall 46 extend between the mating face 40 and the cable receiving face 42. End walls 48 extend between the mating face 40 and the cable receiving face 42 and between the first side wall 44 and the second side wall 46. One or more terminal receiving cavities 50*a*, 50*b*, 50*c* extend between the mating face 40 and the cable receiving face 42. The terminal receiving cavities 50*a*, 50*b*, 50*c* may have the same configuration or may differ in configurations. In addition, the terminal receiving cavities 30*a*, 30*b*, 30*c* may have the same configuration or different configurations from the terminal receiving cavities 50*a*, 50*b*, 50*c*. The terminal receiving cavities are configured to receive terminals 49*a*, 49*b*, 49*c* (FIG. 2) therein. The terminals may be of various configurations, including, but not limited to male terminals and female terminals. Other configurations of the second housing 14 may be used without departing from the scope of the invention.

In the illustrative embodiment shown, the housing 14 has a generally L-shaped configuration, with the first side wall 44 having a recess section or recess 54 provided therein. In the embodiment shown, various terminal receiving cavities 50*a*, 50*b*, 50*c* are offset from each other and from a longitudinal axis of the second housing 14. However, other configurations may be used.

Figure 3:
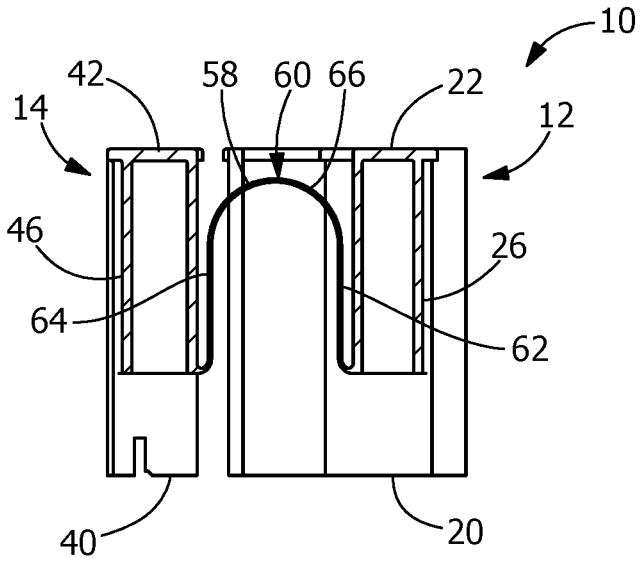
FIG. 3 is cross-section view taken along line 3-3 of FIG. 1.

One or more flexible joining member 60 extends between the first housing 12 and the second housing 14. As shown in FIG. 3, the flexible joining member 60 has a general U-shape with a first leg 62, a second leg 64 and an arcuate portion 66 extending between the first leg 62 and the second leg 64. The first leg 62 is attached to the first side wall 24 of the first housing 12. The second leg 64 is attached to the first side wall 44 of the second housing 14. Other configurations of the flexible joining member 60 may be used without departing from the scope of the invention.

In the embodiment shown, the top surface 58 of the arcuate portion 66 of the flexible joining member 60 is positioned below the planes of the cable receiving face 22 of the first housing 12 and the cable receiving face 42 of the second housing 14. In addition, the first leg 62 and the second leg 64 of the flexible joining member 60 are positioned above the planes of the cable receiving face 22 of the first housing 12 and the cable receiving face 42 of the second housing 14. Consequently, the flexible joining member 60 does not extend beyond the planes of the cable receiving face 22 and the cable receiving face 42 or the planes of the mating face 20 of the first housing 12 and the mating face 40 of the second housing 14.

In the illustrative embodiment shown the first housing 12, the second housing 14 and the flexible joining member 60 are molded as one piece with the flexible joining member 60 molded in the U-shape shown. However, other configurations of the flexible joining member 60 may be used. In addition, in alternate illustrative embodiments, the flexible joining member 60 may be multiple members which are fixed to the first housing 12 and the second housing 12 using known methods of attachment.

When molded or assembled, the first housing 12 and the second housing 14 are positioned in side-by-side relationship, with the flexible joining member 60 extending therebetween. In the initial position, as shown in FIGS. 1 through 4, the mating face 20 of the first housing 12 and the mating face 40 of the second housing 40 are positioned in essentially the same plane. In this position, the flexible joining member 60 is in an initial, unstressed position. Consequently, in the initial, unstressed position, the flexible joining member 60 does not exert force on the first housing 12 or the second housing 14, allowing the first housing 12 and the second housing 14 to remain in position.

The flexible joining member 60 is configured to have a thickness which allows the arcuate portions 66 to flex or resiliently deform without breaking. The particular thickness of the flexible joining member 60 on the type of material and the modulus of elasticity thereof. In addition, a slot 67 is provided in the arcuate portion 66 to allow each portion 69 of the arcuate portion 66 to move independently, providing additional flexibility to the flexible joining member 60.

In use, the molded or assembled electrical connector 10 is moved into engagement with a mating electrical component 70, as shown in FIGS. 4 through 7. In the illustrative embodiment shown, the mating electrical component 70 is a substrate with terminals 72 extending therefrom. However, other configurations of the mating electrical component 70 may be used.

Figure 4:
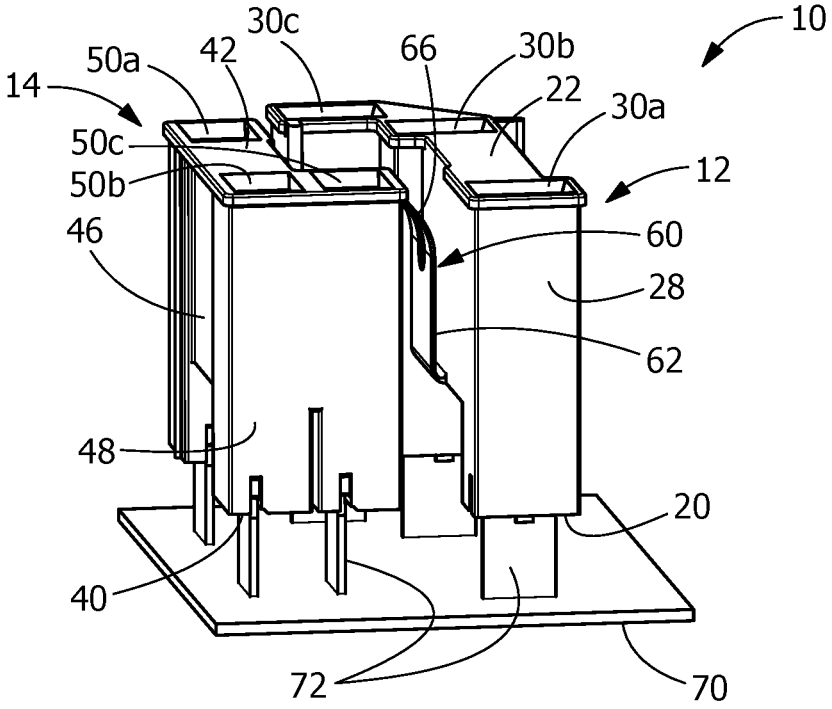
FIG. 4 is a perspective view of the electrical connector of FIG. 1 prior to the first housing and the second housing being mated with a mating electrical component.
Figure 5:
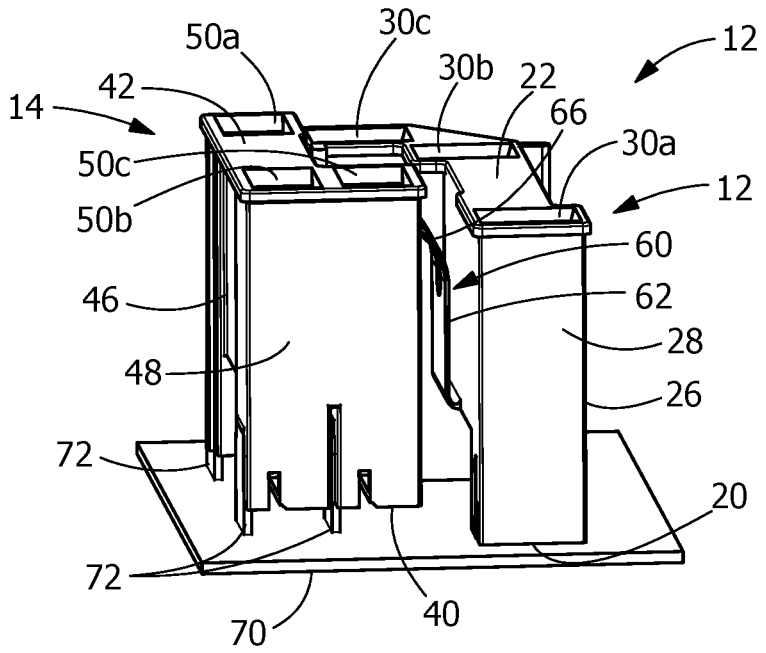
FIG. 5 is a perspective view of the electrical connector of FIG. 1 with a first housing of the electrical connector mated with the mating electrical component.
Figure 6:
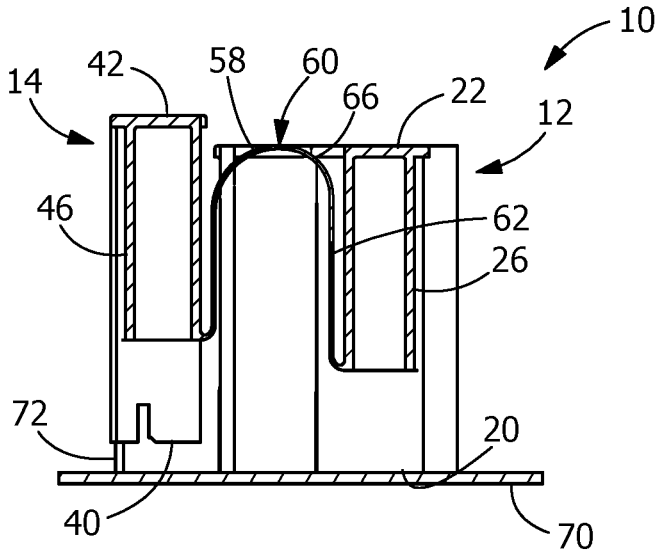
FIG. 6 is cross-section view taken along line 6-6 of FIG. 5.

As shown in FIG. 4, the electrical connector 10 is initially moved into position proximate the mating electrical component 70. In this position, the electrical connector 10 is in the initial position, as previously described, with the mating face 20 of the first housing 12 and the mating face 40 of the second housing 40 are positioned in essentially the same plane and the flexible joining member 60 is in the unstressed position.

With the electrical connector 10 moved proximate the terminals 72 of the mating electrical component 70, one of the housing 12, 14 is moved toward the mating electrical component 70. In the illustrative embodiment shown in FIGS. 5 and 6, the first housing 12 is moved toward the mating electrical component.

As this occurs, the terminals 72 are moved through the mating face 20 of the first housing 12 into the terminal receiving cavities 30*a*, 30*b*, 30*c*. As insertion continues the terminals 72 are moved into mechanical and electrical engagement with the terminals 29*a*, 29*b*, 29*c* of the first housing 12. The force required to mate the first housing 12 mating electrical component 70 is a result of the engagement of the terminals of the first housing 12 with the terminals 72 of the mating electrical component 70. The force needed to mate the first housing 12 with the mating component 70 is often applied by the user or operator to the cable receiving face 22 or the end walls 28.

As a force is applied to the first housing 12 to move the first housing into engagement with the mating electrical component 70, the first housing 12 is moved toward the mating electrical component 70. However, as no force is applied to the second housing 14, the first housing 12 is moved relative to the second housing 14. As this occurs, the flexible joining member 60 is flexed or stressed. As the first housing 12 is moved, the first leg 62 of the flexible joining member 60, which is attached to the first housing 12, is moved accordingly. This movement of the first leg 62 causes portions of the arcuate portion 66 proximate to the first leg 62 to be moved or resiliently deformed in the same direction as the movement of the first leg 62 and the first housing 12.

Figure 7:
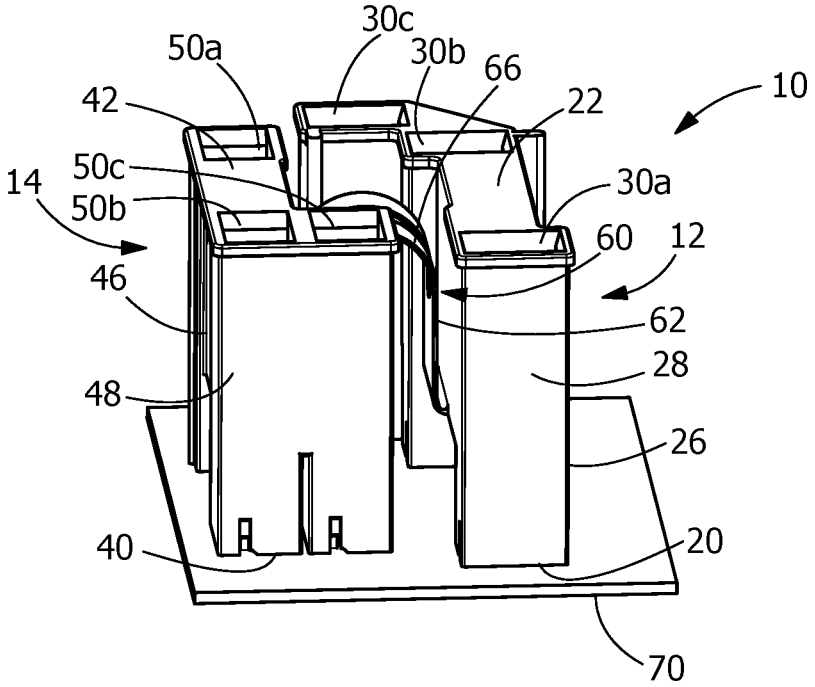
FIG. 7 is a perspective view similar to FIG. 5, with the first housing and a second housing of the electrical connector mated with the mating electrical component.

With the first housing 12 properly inserted onto the mating electrical component 70, the second housing 14 is moved toward the mating electrical component to the position shown in FIG. 7. As this occurs, the terminals 72 are moved through the mating face 40 of the second housing 14 into the terminal receiving cavities 50*a*, 50*b*, 50*c*. As insertion continues the terminals 72 are moved into mechanical and electrical engagement with the terminals 49*a*, 49*b*, 49*c* of the second housing 14. The force required to mate the second housing 14 to the mating electrical component 70 is a result of the engagement of the terminals of the second housing 14 with the terminals 72 of the mating electrical component 70. The force needed to mate the second housing 14 with the mating component 70 is often applied by the user or operator to the cable receiving face 42 or the end walls 48.

As second housing 14 is mated to the mating electrical component 70, the flexible joining member 60, which is provided in a stressed position after the first housing 12 has been mated to the mating electrical component 70, provides additional force to facilitate the mating of the second housing 14. The force is supplied by the resilient movement of the arcuate portion 66 from the stressed position to the unstressed position as the second housing 14 is moved toward the mating electrical component 70 transferring force to the second leg 64 and to the second housing 14.

As the electrical connector 10 has the first housing 12 which is separate from the second housing 14, but connected with flexible joining member 60, the first housing 12 and the second housing 14 can be mated independently to the mating electrical connector 70. This reduces allows the mating forces needed to mate the electrical connector 10 to be divided into two components which act independently. Consequently, the mating force needed to mate the electrical connector 10 to the mating electrical component 70 is reduced compared to an electrical connector in which all of the contacts are mated to the mating electrical component at the same time. This allows for the mating to be done in a more ergonomic and user friendly manner for the user or operator.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a first housing having a first mating face and a first cable receiving face with at least one first terminal receiving cavity extending from the first cable receiving face to the first mating face, at least one first electrical terminal positioned in the at least one first terminal receiving cavity, the first electrical terminal configured to mate with a first mating terminal of a mating electrical component;

a second housing have a second mating face and a second cable receiving face with at least one second terminal receiving cavity extending from the second cable receiving face to the second mating face, the second housing being spaced from the first housing, at least one second electrical terminal positioned in the at least one second terminal receiving cavity, the second electrical terminal configured to mate with a second mating terminal of the mating electrical component;

a flexible joining member extending from the first housing to the second housing, the flexible joining member configured to allow the first housing to move independently of the second housing as the electrical connector is mounted to the mating electrical component;

wherein the at least one first electrical terminal and the first housing can be mated independently to the first mating terminal of the mating electrical component from the at least one second electrical terminal and the second housing.

2. The electrical connector as recited in claim 1, wherein the first mating face of the first housing and the second mating face of the second housing are oriented in the same direction.

3. The electrical connector as recited in claim 2, wherein the first cable receiving face of the first housing and the second cable receiving face of the second housing are oriented in the same direction.

4. The electrical connector as recited in claim 3, wherein the flexible joining member is integrally molded to the first housing and the second housing.

5. The electrical connector as recited in claim 4, wherein the flexible joining member is a U-shaped member with a first leg, a second leg and an arcuate portion extending between the first leg and the second leg, the first leg is attached to the first housing and the second leg is attached to the second housing.

6. The electrical connector as recited in claim 5, wherein the first leg of the flexible joining member extends from a first side surface of the first housing.

7. The electrical connector as recited in claim 6, where the second leg of the flexible joining member extends from a second side surface of the second housing.

8. The electrical connector as recited in claim 1, wherein the first housing has a first L-shaped configuration and the second housing has a second L-shaped configuration, the first housing and the second housing forming a cavity in which the flexible joining member is positioned.

9. An electrical connector for mating to a mating electrical component, the electrical connector comprising:

a first housing having a first mating face and a first cable receiving face;

a second housing have a second mating face and a second cable receiving face, the second housing being spaced from the first housing;

a flexible joining member integrally molded with the first housing and the second housing, the flexible joining member extending from the first housing to the second housing, the flexible joining member configured to allow the first housing to move independently of the second housing, the flexible joining member having a first leg, a second leg and an arcuate portion extending between the first leg and the second leg, the arcuate portion positioned below planes of the first cable receiving face and the second cable receiving face;

wherein the first housing can be mated independently to the mating electrical component from the second housing.

10. The electrical connector as recited in claim 9, wherein the flexible joining member is a U-shaped member, the first leg is attached to the first housing and the second leg is attached to the second housing.

11. The electrical connector as recited in claim 10, wherein the first leg of the flexible joining member extends from a first side surface of the first housing.

12. The electrical connector as recited in claim 11, where the second leg of the flexible joining member extends from a second side surface of the second housing.

13. The electrical connector as recited in claim 12, wherein the first housing has a first L-shaped configuration and the second housing has a second L-shaped configuration, the first housing and the second housing forming a cavity in the first side surface and the second side surface in which the flexible joining member is positioned.

14. The electrical connector as recited in claim 13, wherein the first mating face of the first housing and the second mating face of the second housing are oriented in the same direction.

15. An electrical connector for mating to a mating electrical component, the electrical connector comprising:

a first housing having a first mating face and a first cable receiving face, the first housing having a first recess provided in a first side wall of the first housing, first electrical terminals position in first terminal receiving cavities of the first housing, the first electrical terminals configured to mate with first mating terminals of the mating electrical component;

a second housing having a second mating face and a second cable receiving face, the second housing having a second recess provided in a second side wall of the second housing, the second housing being spaced from the first housing with the first recess facing the second recess, second electrical terminals position in second terminal receiving cavities of the second housing, the second electrical terminals configured to mate with second mating terminals of the mating electrical component;

a flexible joining member positioned in the first recess and the second recess, the flexible joining member extending from the first housing to the second housing, the flexible joining member configured to allow the first housing to move independently of the second housing, the flexible joining member having a first leg, a second leg and an arcuate portion extending between the first leg and the second leg, the arcuate portion positioned below planes of the first cable receiving face and the second cable receiving face;

wherein the first electrical terminals and the first housing can be mated independently to the first mating terminals of the mating electrical component from the second electrical terminals and the second housing.

16. The electrical connector as recited in claim 15, wherein the first mating face of the first housing and the second mating face of the second housing are oriented in the same direction.

17. The electrical connector as recited in claim 16, wherein the flexible joining member is a U-shaped member, the first leg is attached to the first housing and the second leg is attached to the second housing.

18. The electrical connector as recited in claim 17, wherein the flexible joining member is integrally molded to the first housing and the second housing.

19. The electrical connector as recited in claim 18, wherein the first leg of the flexible joining member extends from a first side surface of the first housing and the second leg of the flexible joining member extends from a second side surface of the second housing.

20. The electrical connector as recited in claim 19, wherein the first housing has a first L-shaped configuration and the second housing has a second L-shaped configuration.

* * * * *